US006277325B1

(12) United States Patent
Schmitz et al.

(10) Patent No.: US 6,277,325 B1
(45) Date of Patent: Aug. 21, 2001

(54) STEELWORKS CONVERTER WITH CONE COOLING SYSTEM

(75) Inventors: Günter Schmitz; Marcel Fasswald, both of Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/462,668

(22) PCT Filed: Jun. 15, 1998

(86) PCT No.: PCT/DE98/01634

§ 371 Date: Feb. 3, 2000

§ 102(e) Date: Feb. 3, 2000

(87) PCT Pub. No.: WO99/02740

PCT Pub. Date: Jan. 21, 1999

(30) Foreign Application Priority Data

Jul. 8, 1997 (DE) ..... 197 30 250

(51) Int. Cl.[7] ..... C21B 7/10
(52) U.S. Cl. ..... 266/193; 266/241
(58) Field of Search ..... 266/241, 193, 266/194, 243

(56) References Cited

U.S. PATENT DOCUMENTS

| | | | | |
|---|---|---|---|---|
| 3,963,223 | * | 6/1976 | Eysn | 266/241 |
| 4,085,924 | * | 4/1978 | Fisher et al. | 266/241 |
| 4,128,232 | * | 12/1978 | Nagati | 266/241 |
| 4,278,241 | * | 7/1981 | Shadid | 266/243 |

* cited by examiner

*Primary Examiner*—Scott Kastler
(74) *Attorney, Agent, or Firm*—Cohen, Pontani, Lieberman & Pavane

(57) ABSTRACT

The steelworks converter on the vessel cone of which a cone cooling system is provided, having sinuously arranged lines for channeling the cooling medium, which open into at least one channel-like collector in the top and bottom regions of the converter head. At least one cooling medium supply and discharge is provided for the cooling medium. Collecting pipe is provided in the region of the bottom collector, that the collecting pipe is spaced away from at least one of the side walls of the bottom collector. The collecting pipe has at least one closable drain and is in communication with the bottom collector in such a way that the cooling medium in the collector can be channeled into the interior of the collecting pipe.

15 Claims, 5 Drawing Sheets

STEELWORKS CONVERTER WITH CONE COOLING SYSTEM

BACKGROUND OF THE INVENTION

1. Field of the Invention

The invention concerns a steelworks converter on the vessel cone of which a cone cooling system is provided. The cooling system includes a multiplicity of cooling medium lines which open into channel-like collectors. At least one cooling medium supply and discharge being provided.

2. Disscussion of the Prior Art

DE 33 30 237 C2 discloses a metallurgical reaction vessel, in particular a steelworks converter, the vessel cone of which is provided with a so-called cone cooling system. The cone cooling system in this case comprises sinuously arranged pipes, a plurality of pipes—in the present example three—arranged regularly in parallel transporting the cooling medium in the same direction. The individual pipes, arranged essentially parallel to the central axis of the converter, end at the top and bottom in channel pieces.

DE 30 48 199 C2 discloses a vessel cone cooling system which comprises a pipeline arranged spirally around the converter cone.

In certain operating cases, it is required to drain the cone cooling system as quickly as possible. During converter operation, considerable damage can occur to the cooling elements of the converter cone and considerable amounts of water can escape. Under some circumstances, the converter vessel can no longer be tilted to do this, in order to prevent cooling water from penetrating into the region of the steel ladle or the slag ladle.

No measures for quick drainage of the cooling medium are known from the documents referred to above.

SUMMARY OF THE INVENTION

It is therefore the object of the present invention to provide, by means which are of a simple design, a discharge for the cooling medium of the cone cooling system with which the cooling medium can be drained in a certain time out of the cooling system, without the cooling elements being damaged by excessive pressure because of inadmissible vapor formation.

According to the invention, a collecting pipe is provided in the region of the bottom collector of the cooling medium. The collecting pipe is in communication with the collector in such a way that the cooling medium passes via openings or via connecting pipes from the collector into the collecting pipe, the collecting pipe having at least one closable drain.

The arrangement according to the invention makes it possible for the cooling medium to be drained quickly out of the cooling elements of the cone cooling system, especially in emergency situations.

Cone cooling systems usually comprise sinuously arranged cooling elements. This arrangement makes draining the cooling system laborious and take a relatively long time, since, for fluidics-related reasons, the individual segments are not connected to one another, or only via connecting pipes of a diameter which is deliberately kept small. However, the prolonged flowing away of the cooling medium entails the risk of vapor formation, which can lead to significant damage, especially in the case of hot converters.

The collecting line proposed according to the invention forms an endless ring, on which any number of drains are provided. In an advantageous embodiment, the ring can be shut off in ring portions by means of fittings, so that there is the possibility of also allowing individual segments to be quickly drained on their own in an emergency—for example in the event of damage.

In the case of the collecting line arranged in the collector, openings designed as a slit or as bores are provided, through which the cooling medium enters the collecting pipe. To ensure an adequate exchange between the collector and the collecting pipe, with the water in the collecting pipe at the same time being refreshed, the entire free surface area of the openings is made to be of a size which corresponds to 5 times the outlet surface area of the associated cooling medium discharge.

In a further advantageous embodiment, the pieces of pipe connecting the individual converter cone segments are provided with compensators, so that stresses are avoided, both on the cone and on the collecting line.

It is also proposed to design these pieces of pipe connecting the converter cone segments as T pieces and to provide them with shut-off elements. This allows any desired drainage program of the collecting pipe to be set in a simple way, provided that vents are provided in the individual segments.

In a another embodiment, the collecting pipe is arranged around the cone as a ring line outside the collector and is connected to the collector via connecting pipes. In the case of this embodiment, it is proposed to pass a partial flow through the collecting pipe in order to provide fresh water here during operation.

BRIEF DESCRIPTION OF THE DRAWING

An example of the invention is represented in the attached drawing, in which.

DETAILED DESCRIPTION OF PREFERRED EMBODIMENTS

Figure 1A:
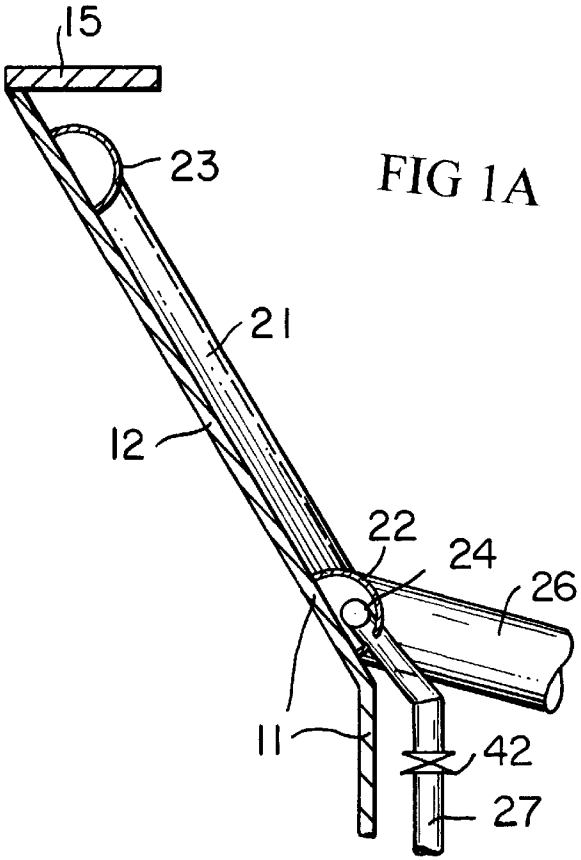
FIG. 1*a* is a section along line a—a in FIG. 1.
Figure 1:
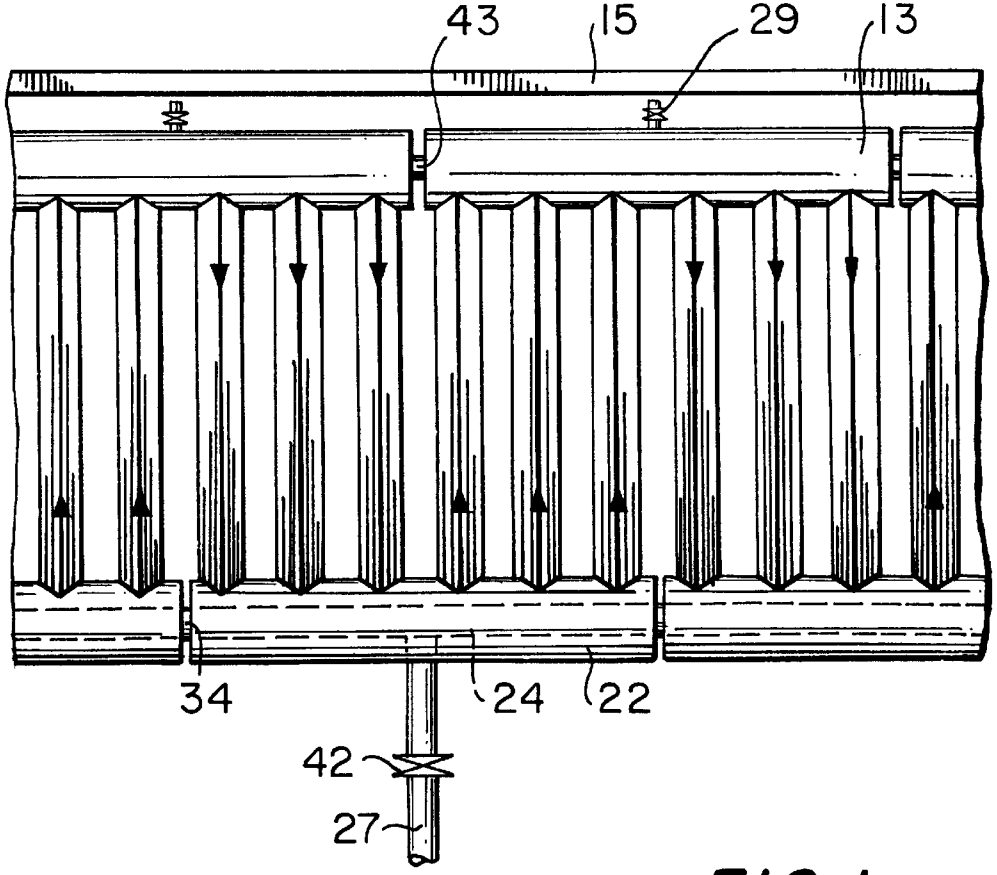
FIG. 1 shows a diagram of the cone cooling system.
Figure 2A:
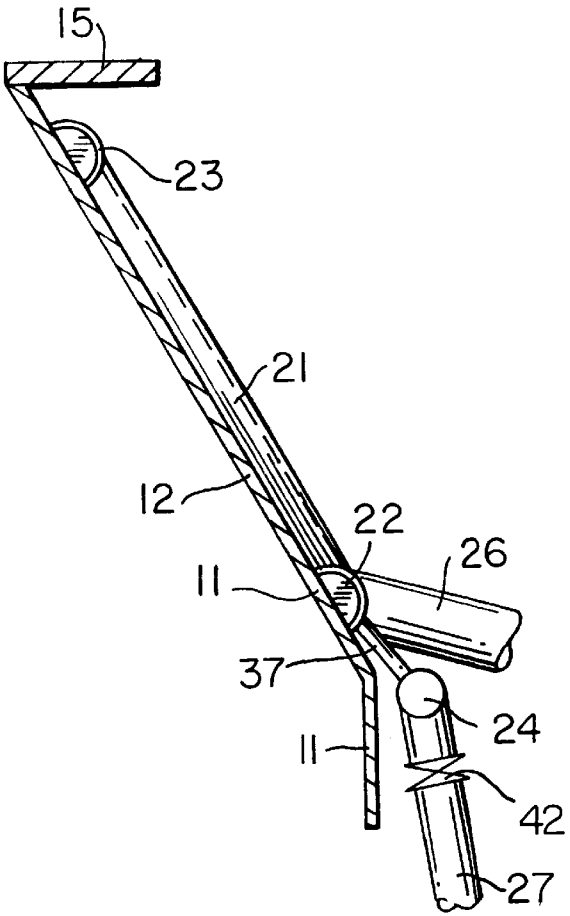
FIGS. 2 and 2*a* are views similar to FIGS. 1 and 1*a* of a further embodiment.
Figure 2:
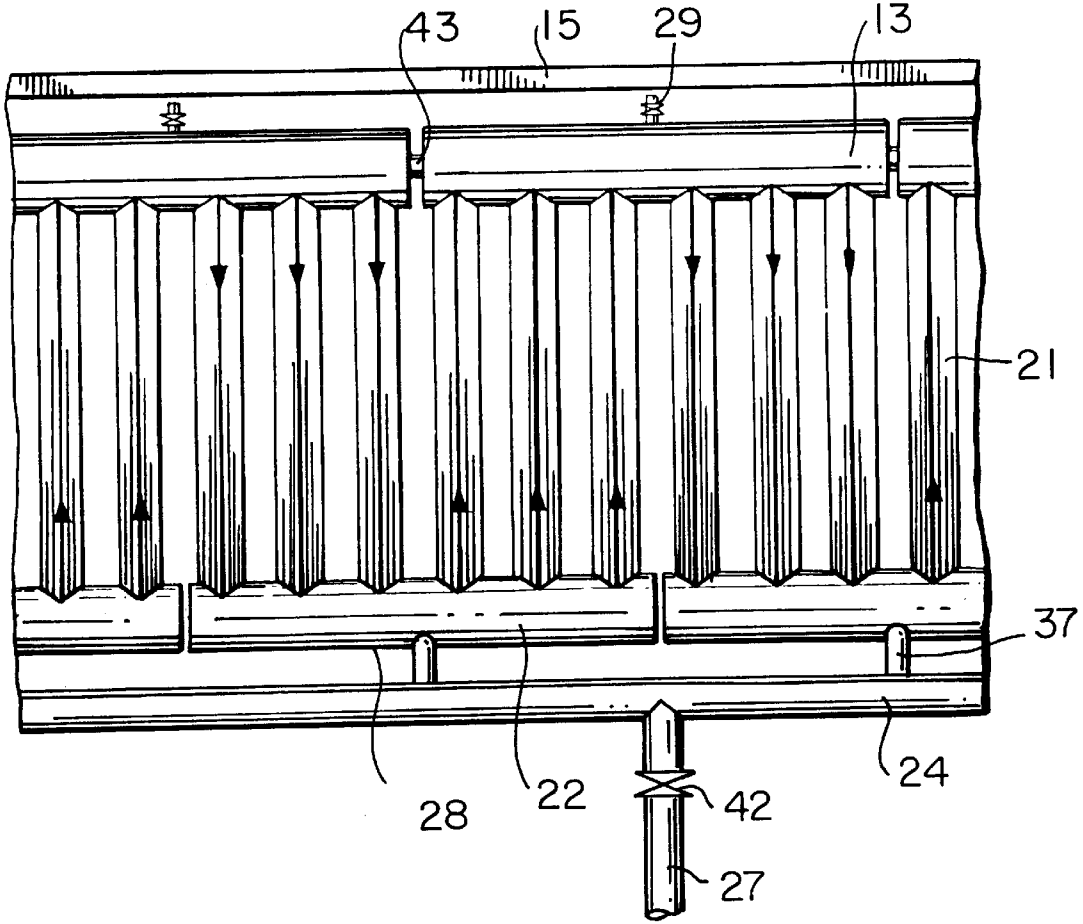
Figure 3A:
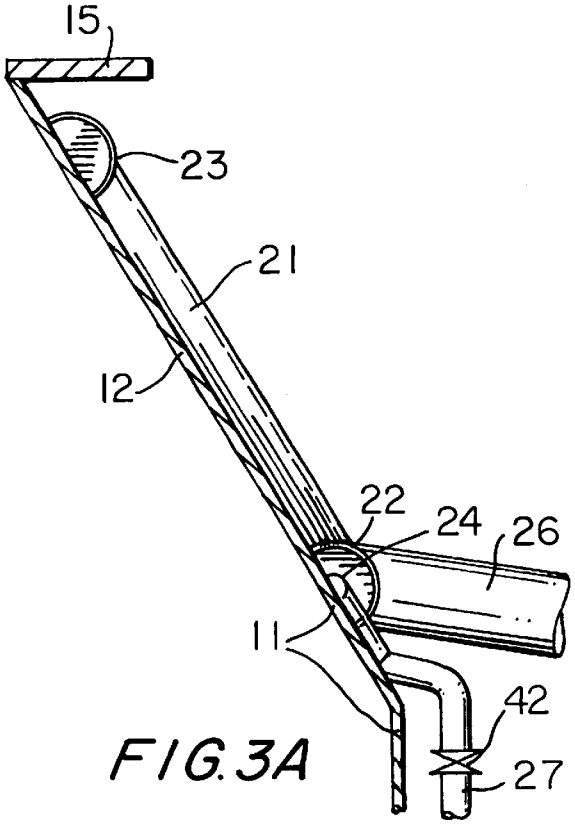
FIGS. 3 and 3*a* show another embodiment.
Figure 3:
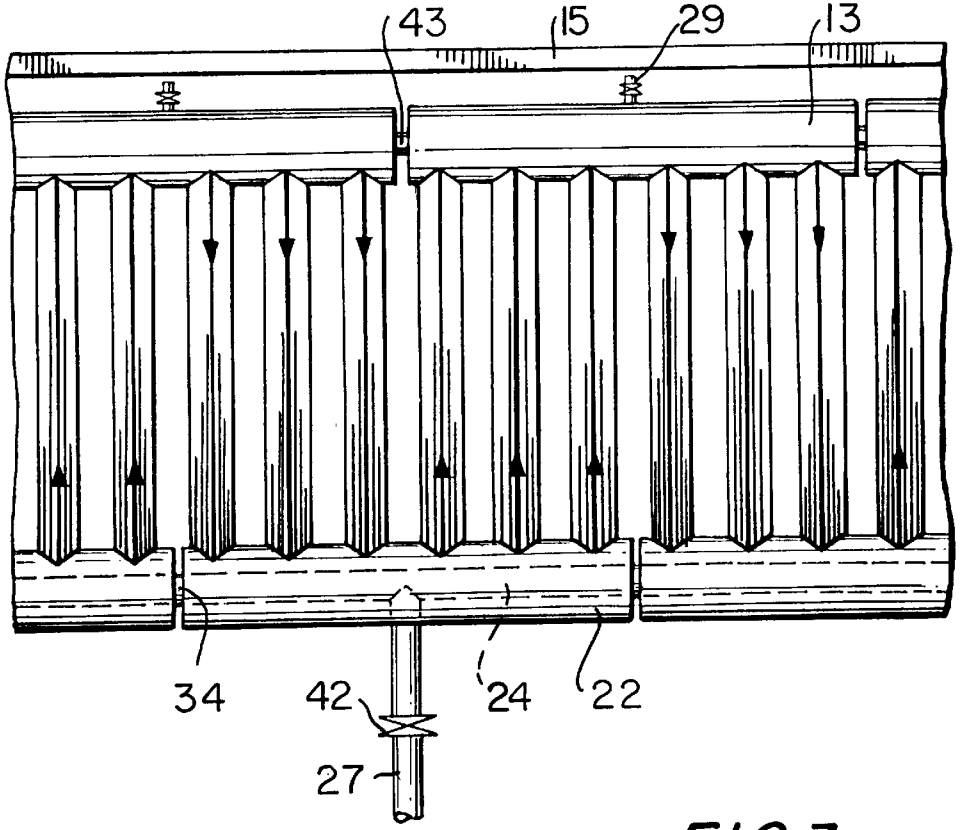

In FIG. 1, a detail of a converter vessel 11 is shown in the center, to be precise of the converter cone 12 including the terminating flange 15, with segments 13, which have sinuously arranged pipes 21. The pipes 21 open at the top into a collector 23 and at the bottom into a collector 22. In FIG. 1*a*, a collecting pipe 24 is provided in the collector 22, in FIGS. 2 and 2*a* this collecting pipe 24 is arranged outside the collector 22 and in FIGS. 3 and 3*a* this collecting pipe 24 is fitted as a half-pipe on the converter cone 12, lying inside the collector 22. Fitted onto the collecting pipe 24 in 1*a* to 1*c* is a drain 27, which can be shut off by shut-off elements 42.

The collecting pipe 24 provided in the collector 22 is connected between the segments via pieces of pipe 34. The collecting pipe 24 shown in FIGS. 2 and 2*a*, arranged outside the outer wall 28, is connected to the collector 22 via connecting pipes 37.

Shown in FIGS. 1, 1*a*, 3 and 3*a* is a section through the converter cone with a pipe 21, the collector 22 and the internal collecting pipe 24. In 2, the collecting pipe 24 lies outside the collector 22, the collecting pipe 24 being connected to the collector 22 via the connecting pipes 37. Also connected to the collector 22 is a cooling medium discharge 26. Provided on both the internal and external collecting pipes 24 is the drain 27, which can be shut off by the shut-off element 42.

In the top collector 23 there is provided at least one openable vent 29.

Figure 4A:
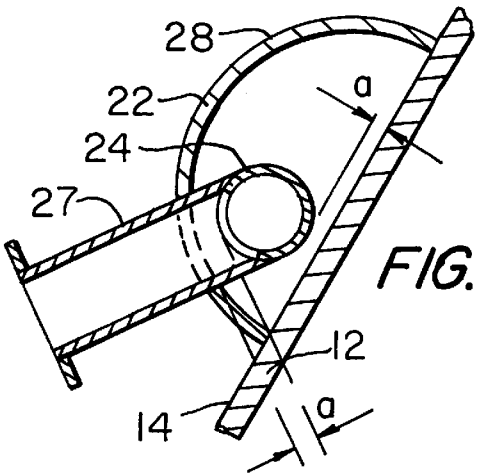
FIGS. 4*a*, 4*b* and 4*c* show a detail of the collecting line and of the collector.

Shown in the detail in FIG. 4*a* is the collecting pipe 24, which in the bottom collector 22 is spaced at approximately equal distance from the wall 14 of the converter cone 12 and from the base of the outer wall 28 of the collector 22 by a distance "a". Connected to the collecting pipe 24 is the drain 27.

Figure 4C:
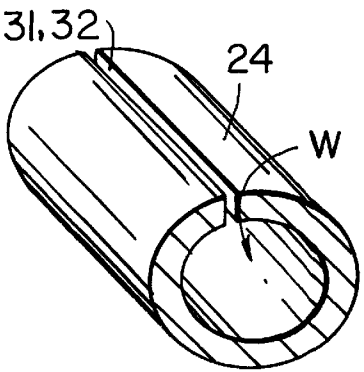
Figure 4B:
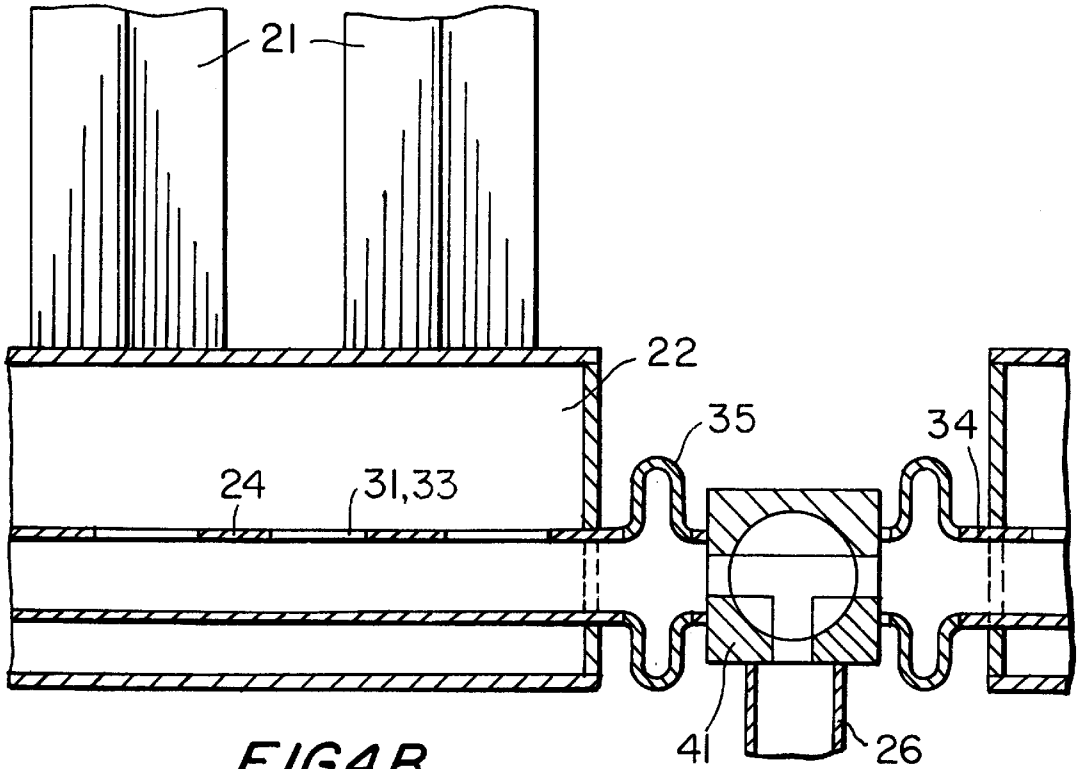

Shown in FIG. 4*a* is a section through the collector 22, with a collecting pipe 24 which has openings 31, to be precise in FIG. 4*b* in the form of bores 33 and in FIG. 4*c* in the form of slits 32. The slits are in this case arranged in such a way that the flow of the cooling medium W on the way to the interior space of the collecting pipe 24 is countered by resistance, here as an opening wedge in the direction of the pipe interior.

Furthermore, FIG. 4*b* shows the pieces of pipe 34 which are connected to the collector 22 via compensators 35. Furthermore, the pieces of pipe 34 can be shut off by a shut-off element 41, here in the form of a threeway cock, which is connected to the cooling medium discharge 26.

Figure 5:
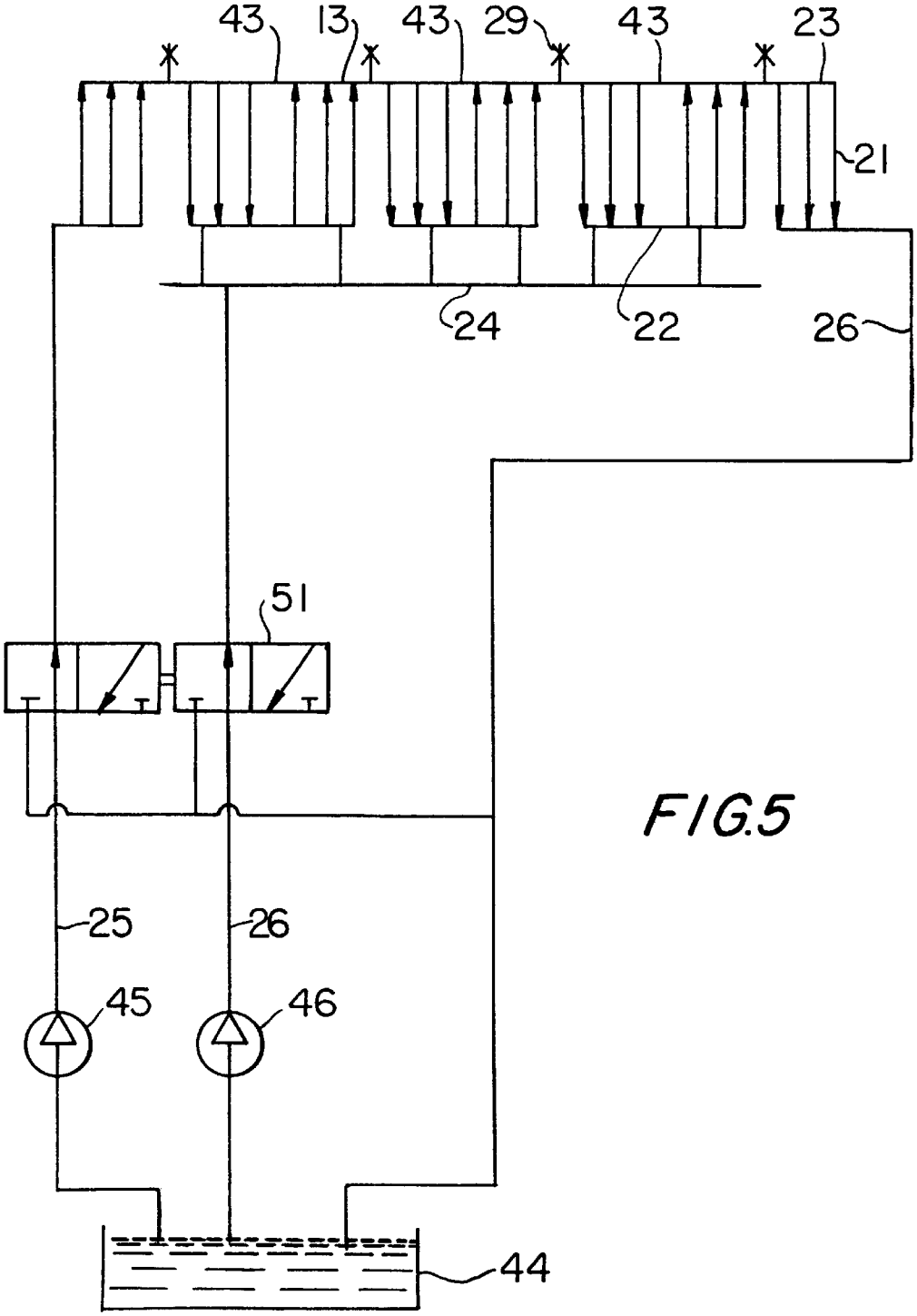
FIG. 5 shows a diagram of the drainage layout

FIG. 5 shows the layout of the segments 13 with the sinuously arranged pipes 21, which are connected at the top to the collector 23 and at the bottom to the collector 22.

The collector 23 is connected to the cooling medium supply 25 and to the cooling medium discharge 26 and, in addition, is connected to the collecting pipe 24. The collecting pipe 24 is in communication with a water supply 36.

The cooling medium supply 25 and the water supply 36 can be switched over by means of a changeover valve 51. In this case, the direction of the flow fed via the cooling medium supply 25 and the water supply 36 is reversed.

It is also shown in this diagram that the cooling medium supply 25 serves with a pump 45 for the main flow, that is to say approximately 85–95% of the amount of water, the water supply 36 serves with a pump 46 for the secondary flow, that is to say approximately 5–15% of the amount of water, and the cooling medium discharge 26 serves after its drainage for supplying air to the other segments via the connecting piece 43.

The invention is not limited by the embodiments described above which are presented as examples only but can be modified in various ways within the scope of protection defined by the appended patent claims.

What is claimed is:

1. A steelworks converter, comprising: a vessel cone; a cone cooling system provided on the vessel cone and having sinuously arranged lines for channeling a cooling medium, which open into at least one channel collector at top and bottom regions of the converter cone; at least one cooling medium supply and discharge provided for the cooling medium; and a collecting pipe provided in a region of the bottom collector so as to be spaced away from at least one side wall of the bottom collector, the collecting pipe having a closable drain and being in communication with the bottom collector so that the cooling medium in the collector rapidly runs into the collecting pipe when the cooling medium supply is stopped.

2. A steelworks converter as defined in claim 1, wherein the collecting pipe is arranged so as to be spaced at approximately equal distance from both side walls and a base of the bottom collector, the collecting pipe having a wall provided with openings via which the cooling medium can be channeled from the bottom collector into an interior of the collecting pipe.

3. A steelworks converter as defined in claim 2, wherein the openings are formed as a slit.

4. A steelworks converter as defined in claim 2, wherein the openings are bores.

5. A steelworks converter as defined in claim 2, wherein the openings of the collecting pipe have a form that hinders an in-flow of the cooling medium during operation.

6. A steelworks converter as defined in claim 5, wherein the openings of the collecting pipe have a conical shape with side walls that open in a direction of coolant flow.

7. A steelworks converter as defined in claim 2, wherein the openings are configured so that an entire free surface area of the openings corresponds to at most 5 times an outlet surface area of the cooling medium discharge.

8. A steelworks converter as defined in claim 2, wherein the converter cone cooling system is divided into segments, and further comprising closed pieces of pipe that connect the collecting pipes that are arranged in the segments and provided with openings.

9. A steelworks converter as defined in claim 8, and further comprising compensators arranged to connect each of the closed pieces of pipe to a wall of the converter cone segments.

10. A steelworks converter as defined in claim 8, wherein the closed pieces of pipe are shaped as T pieces, and further comprising a shut-off element provided for each drain.

11. A steelworks converter as defined in claim 1, wherein the collecting pipe is spaced away from an outer wall of the bottom collector, and further comprising connecting pipes that connect the collecting pipe to the bottom collector.

12. A steelworks converter as defined in claim 11, and further comprising shut-off elements operatively arranged to shut-off the collecting pipe, at least one cooling medium discharge being respectively provided between two shut-off elements.

13. A steelworks converter as defined in claim 12, wherein the collecting pipe is connected to a water supply, via which a partial amount equal to between 5 to 15% of a main flow of coolant can be channeled.

14. A steelworks converter as defined in claim 1, and further comprising at least one openable vent in the top collector.

15. A steelworks converter as defined in claim 1, and further comprising changeover valves operatively provided so as to switch over the cooling medium supply and, if appropriate, the water supply, and switch off the cooling medium discharge.

* * * * *